US005818041A

United States Patent [19]

Mordehai et al.

[11] Patent Number: 5,818,041

[45] **Date of Patent: *Oct. 6, 1998**

[54] MASS SPECTROMETER SYSTEM AND METHOD FOR TRANSPORTING AND ANALYZING IONS

[75] Inventors: Alexander Mordehai, Mountain View; Sidney E. Buttrill, Jr., Palo Alto, both of Calif.

[73] Assignee: Varian Associates, Inc., Palo Alto, Calif.

[ * ] Notice: The term of this patent shall not extend beyond the expiration date of Pat. No. 5,672,868.

[21] Appl. No.: 854,855

[22] Filed: May 12, 1997

Related U.S. Application Data

[62] Division of Ser. No. 605,346, Feb. 16, 1996, Pat. No. 5,672,868.

[51] Int. Cl.[6] ..... H01J 49/00

[52] U.S. Cl. ..... 250/281; 250/242; 250/288

[58] Field of Search ..... 250/281, 292, 250/290, 288, 288 A

[56] References Cited

U.S. PATENT DOCUMENTS 5,481,107 1/1996 Takada et al. ..... 250/281
5,672,868 9/1997 Mordehai et al. ..... 250/281

FOREIGN PATENT DOCUMENTS 0237259 9/1987 European Pat. Off. ..... 250/292

*Primary Examiner*—Jack I. Berman
*Attorney, Agent, or Firm*—Bella Fishman

[57] ABSTRACT

A mass spectrometer system for performing a separation of ions from neutrals and mass analyzing ions comprising a inductively coupled plasma ion generating source with an ion introducing system, a radio-frequently ion guide and a mass analyzer disposed within a vacuum chamber. The space between the radio-frequency ion guide and the ion introduction system defined an aerodynamic jet region which is used for directing a sample containing ions to be analyzed to the entrance of a radio-frequency ion guide and the via the radio-frequency ion guide to the mass analyzer.

12 Claims, 9 Drawing Sheets

MASS SPECTROMETER SYSTEM AND METHOD FOR TRANSPORTING AND ANALYZING IONS

This is a divisional of the U.S. application Ser. No. 08/605,346 filed Feb. 16, 1996, now U.S. Pat. No. 5,672,868.

FIELD OF INVENTION

The present invention relates to mass spectrometry and in particular to atmospheric pressure ionization (API) ion sources and interfaces for mass spectrometers and methods therefor.

Atmospheric pressure ionization and, in particular, electrospray ionization has become an extremely powerful analytical technique for organic and biochemical analyses by mass spectrometry. In 1968–1970M. Dole described the use of an electrospray ion source with a mass analyzer for the determination of molecular weights of simple polymers such as polyethyleneglycol (M. Dole, et al., *J.Chem. Phys.,* 1968, v.49, p. 2240; and L. L. Mack et al., *J. Chem. Phys.* 1970, v.52, p.4977). In this system, ions were collected from atmospheric pressure into a first vacuum region through a short nozzle in the center of a first conical skimmer. The first skimmer was concentrically aligned to a second skimmer separating the first vacuum region from a second, mass analyzer vacuum region. The first and second vacuum regions with only one physical connection through the center-orifice of the second skimmer were differentially pumped. Both ions and neutrals were focused in an aerodynamic jet region and directed into the mass analyzer vacuum region.

Later developments presented the curtain gas API interface in which a counter flow of a curtain gas in an ion sampling region prevented liquid droplets of the sprayed aerosol from entering the vacuum system (U.S. Pat. No. 4,137,750 for "Method and Apparatus for Analyzing Trace Components Using a Gas Curtain" issued to J. B. French et al.). The curtain gas provided a shield for the ion sampling nozzle from the atmospheric pressure side which resulted in preferential sampling of ions into the vacuum system relative to sampling of other bulky particles, such as liquid microdroplets. There are a few other prior art designs which utilize the ion sampling nozzle or the ion sampling capillary with concentrically aligned conical shimmers. For example, in the U.S. Pat. No. 5,298,744 for "Mass Spectrometer" issued to T. Mimura et al., the short heated nozzle and the concentric skimmer are used. In other designs disclosed in the U.S. Pat. No. 5,164,593 for "Mass Spectrometer System Including an Ion Source Operable Under High Pressure", issued to J. R. Chapman et al., and in the U.S. Pat. No. 5,298,743 for "Mass Spectrometry and Mass Spectrometer, issued to Y. Kato et al., several concentric conical skimmers are used in conjunction with the differential pumping.

Another design incorporated a long capillary as an ion sampling device, which was aligned with a conical skimmer separating a first vacuum region from the differentially pumped mass analyzing region (U.S. Pat. No. 4,542,293 for "Process and Apparatus for Changing the Energy of Charged Particles Contained in a Gaseous Medium", issued to Fenn et al.). In a similar system, a heated metal capillary was used with the concentrically aligned skimmer, wherein small ion droplets and ion clusters were heated in the capillary, thus resulting in almost complete evaporation and therefore more efficient pump down in the first vacuum region (U.S. Pat. No. 4,977,320 for "Electrospray Ionization Mass Spectrometer with New Features", issued to S. K. Chowdhury et al.). However, the effective evaporation process of microdroplets requires a relatively high temperature of the capillary. The elevated temperature may cause degradation of examined compounds, such as non covalently bound peptide complexes.

Additional advanced interfaces were introduced to increase ion separation not only from the heavy particles, such as liquid micro droplets, but also from the light neutrals, such as air and solvent molecules. All these systems are designed to enhance ion transmission from the first vacuum region to the mass analyzing region by incorporating different ion optics between these regions. In the U.S. Pat. No. 5,157,260 for "Method and Apparatus for Focusing Ions in Viscous Flow Jet Expansion Region of an Electrospray Apparatus, issued to I. C. Mylchreest et al., a tube ion lens is used at the end of the ion sampling capillary in the first vacuum region to improve transmission of ions into a mass analyzing region through the concentric skimmer in the second vacuum region. The mass spectrometer system disclosed in the U.S. Pat. No. 5,352,892 for "Atmospheric Pressure Ion Interface for a Mass Analyzer", issued to A. Mordehai et al.) utilizes a short nozzle and flat skimmers with multiple concentric electrodes therebetween for creating drift regions for ions while scattering and pumping away light neutrals. In one design, an radio-frequency quadrupole ion guide was used to capture and focus ions while pumping away the neutrals (D. J. Douglas and J. B. French, J.Am.Soc. Mass. Spectrom., 3,398-408; the U.S. Pat. No. 4,963,736 for "Mass Spectrometer and Method and Improved Ion Transmission", issued to D. J. Douglas et al.).

In prior art designs disclosed above ions are sampled into the vacuum chamber through a set of concentric separators or skimmers axially aligned with the ion sampling device, which defines the trajectory of ion injection, as well as with the axis of the mass analyzer. This interface design usually requires high accuracy in the mechanical alignment of the concentric skimmers for reproducible results. Partial ion neutral separation causes significant ion losses. These mass spectrometer systems are characterized by excessive chemical noise and system contamination.

A different approach for enhancing the separation of ions from neutrals was suggested in the U.S. Pat. No. 5,171,990 for "Electrospray Ion Source With Reduced Neutral Noise", issued to I. C. Mylchreest et al. The axis of an ion sampling capillary was directed away from the opening in the skimmer. In this design ion transport is sacrificed to achieve discrimination against bulky neutrals such as liquid microdroplets due to the misalignment of the axes. Also, the electrostatic ion optics and the skimmer are located in the way of the aerodynamic jet, thus resulting in increased contamination, increased chemical noise and decreased ruggedness for the whole system.

In the U.S. Pat. No. 5,481,107 for "Mass Spectrometer", issued to Y. Takada et al., an electrostatic lens was used to deflect the direction of the movement of the ions in the region between an ion source and a mass analyzer to achieve ion-neutral separation. This design being an advanced one has a drawback in certain respects. The electrostatic lens in this design is positioned in the relatively high pressure vacuum region. It is a well known fact that electrostatic optics under high vacuum pressure cannot provide an efficient ion focusing due to intensive ion scattering, which leads to ion loss and reduced ion transmission.

SUMMARY OF THE INVENTION

Accordingly it is an object of the present invention to provide a mass spectrometer system with a radio-frequency ion guide and method which improves ion transport efficiency from atmospheric pressure or reduced atmospheric pressure to a vacuum system of the mass analyzer while decreasing the transport efficiency of neutral particles such as air molecules, solvent clusters or small liquid droplets.

It is another object of the present invention to improve ruggedness for the mass spectrometer system.

It is still further object of the present invention to decrease the chemical noise level of the mass spectrometer system and improve its sensitivity.

Yet another object of the present invention is to provide the mass spectrometer system and a method for alteration of ion flow direction with a radio-frequency multipole electrical field in a vacuum chamber.

It is an advantage of the present invention that the ion introduction device and ion optics of the mass spectrometer system do not require precise mechanical alignment.

The invention provides a mass spectrometer system which comprises an ion source for generating ions at or near atmospheric pressure, an ion sampling device, a vacuum chamber located near the ion source, and a radio-frequency ion guide contained within the vacuum chamber. The ion sampling device comprises inlet and outlet openings with a narrow passage therebetween for transporting ions therethrough in the direction of the axis of the sampling device. The vacuum chamber has at least two vacuum regions with the region receiving the flow of gas and ions from the ion sampling device having the highest pressure. The ion sampling device and the radio-frequency ion guide are arranged so that the direction of the flow of ions and gas particles is angled with respect to the axis of the ion guide, and intersects it, or nearly intersects it, at the entrance of the ion guide. The radio-frequency ion guide deflects the flow of ions out of the flow of neutral gas, thus achieving a separation of the ions from the gas particles, large charged droplets or solid particles which may be entrained in the gas flow. A device for introducing a selected neutral gas into the radio-frequency ion guide may be provided to improve the focusing of the ions within the ion guide. The mass analyzer is positioned to receive ions exiting the radio-frequency ion guide.

The invention provides a method of separating ions from neutral molecules. Ions are formed at or near atmospheric pressure and enter a vacuum system through a first aperture of the ion sampling system which forms an aerodynamic jet containing ions entrained within the aerodynamic jet of neutral gas. The jet is directed to the radio-frequency ion guide. The direction of the jet is not parallel to the axis of the ion guide, but is set to intersect or approach it near the entrance to the ion guide. A pressurized buffer gas is admitted into the entrance of the radio-frequency ion guide. Ions are transferred from the ion guide exit into a mass spectrometer. The pressure of the buffer gas is adjusted to obtain the desired ion signal and mass resolution from the mass analyzer.

The advantages of the present invention will become clear from the detailed description given below in which preferred embodiments are described in relation to the drawings. The detailed description is presented to illustrate the present invention, but is not intended to limit it.

DESCRIPTION OF THE PREFERRED EMBODIMENTS

Figure 1:
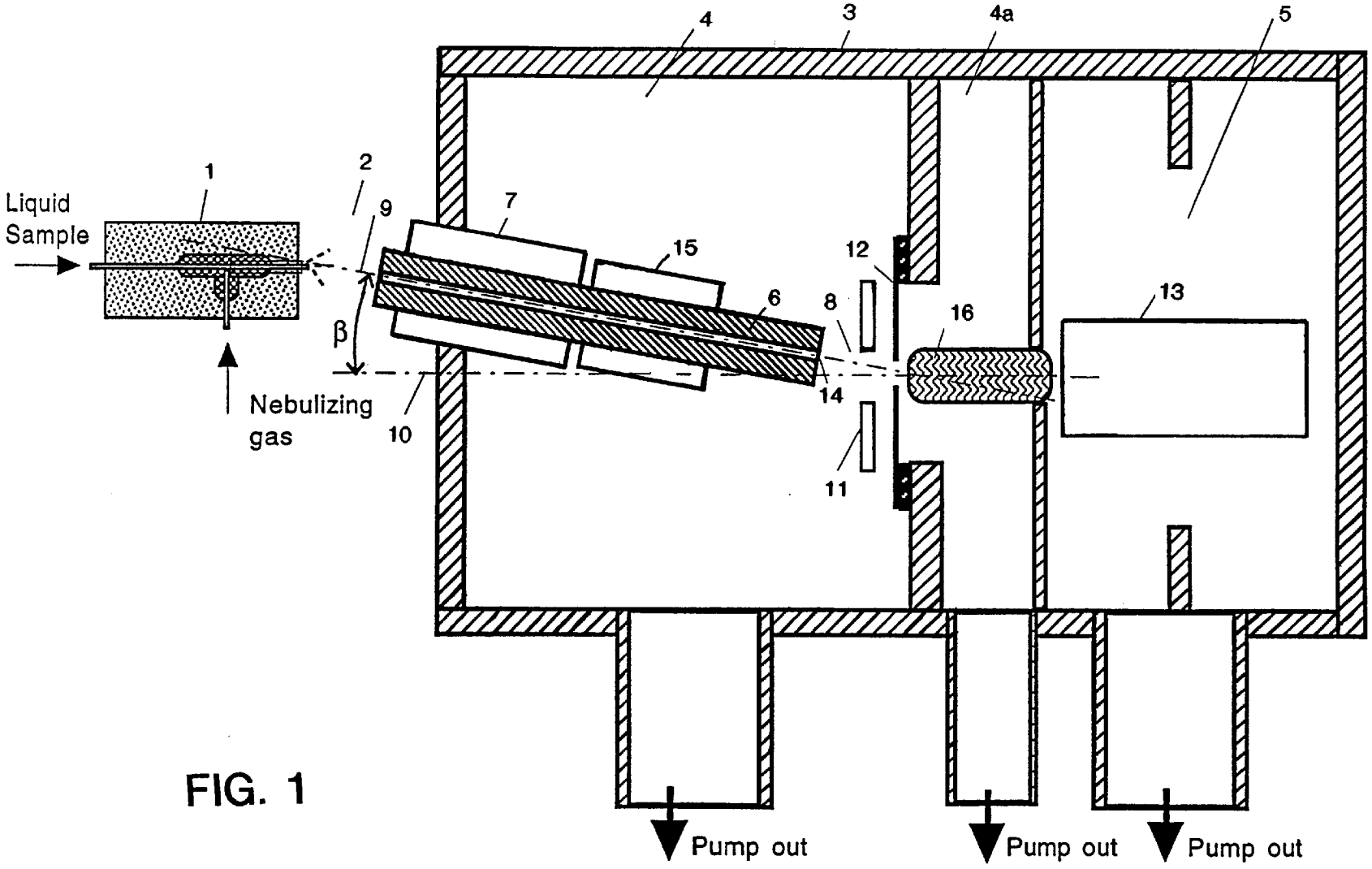
FIG. 1 shows a schematic illustration of a mass spectrometer system utilizing a tilted capillary according to one embodiment of the present invention.

FIG. 1 shows a mass spectrometer system in accordance with a preferred embodiment of the present invention. The system comprises atmospheric pressure ion source 1 for producing ions in atmospheric pressure region 2 and vacuum chamber 3 which is placed next to ion source 1. Vacuum chamber 3 has first vacuum region 4 at the front of the vacuum chamber and second vacuum region 5 at the back of the vacuum chamber and intermediate vacuum region 4*a* between first vacuum region 4 and second vacuum region 5. The pressure in these regions is progressively reduced from the front to the back of vacuum chamber 3. Ions are generated at atmospheric pressure in the region 2 by electrospray ionization technique with a pneumatically assisted spray. The ions are sampled into first vacuum region 4 through capillary tube 6 functioning as an ion sampling device. Capillary tube 6 is electrically isolated from vacuum chamber 3 with insulating union 7. The system further comprises a radio-frequency ion guide 16 for extracting ions from aerodynamic jet region 8 and transporting them into second vacuum region 5 for mass analysis of ions by mass analyzer 13. According to the present invention, central axis 9 of the bore of capillary tube 6 intersects main axis 10 of the radio-frequency ion guide 16 at an angle β. Capillary tube 6 is positioned in a way to direct ions within first vacuum region 4 to the entrance of the radio-frequency ion guide. Central axis 9 approaches a main axis 10 within the entrance of the radio-frequency ion guide. Ion optical lens 11 and restrictor 12 are positioned in front of radio-frequency ion guide 16 for efficient ion injection into the radio-frequency ion guide 16. Ion optical lens 11 and restrictor 12 are concentrically aligned with main axis 10. Electrical potentials are applied to capillary tube 6, extraction lens 11 and restrictor 12. These potentials are adjusted for optimum ion transport efficiency and are typically in the range of about ±300 V. The potential difference between capillary tube 6 and restrictor 12 can be used to produce collisionally induced dissociation (CID) due to the collisions of the ions with neutrals in aerodynamic jet region 8. CID allows for obtaining additional structural information on analyzed samples. To facilitate CID, it is possible to preheat ions by raising the temperature on the capillary tube with heater 15. The temperature of heater 15 can also be adjusted to achieve the best sensitivity for a particular sample. Because all microdroplets from the ion source are separated from the ions by the invention, it is not necessary to elevate the temperature of the capillary 6 to completely evaporate all droplets. This is an advantage for heat sensitive compounds. The conventional operating temperature for the capillary heater is in the range from about 20° C. to 350° C.

When used with electrospray ionization the temperature of heater 15 can be adjusted to provide a sufficient amount of heat for the evaporation of microdroplets of the analyte solvent, the evaporating solvent pressurizing the radio-frequency ion guide entrance. The evaporated solvent molecules serve as a buffer gas at the ion guide entrance, thus providing improved ion transmission.

In this embodiment, ions introduced into the vacuum through capillary tube 6 are extracted from the aerodynamic jet region by the radio-frequency ion guide within intermediate vacuum region 4*a* while all neutrals maintain the original direction of motion along the central axis of capillary tube 6. Hence neutrals and microdroplets can be efficiently pumped away without interfering with mass analyzer 13.

The individual rods of radio frequency guide 16 are positioned offset from central axis 9 to avoid collisions with neutrals, thus preventing contamination and chemical noise in the system and providing more efficient pump out for neutrals in intermediate region 4*a*. Therefore the use of a tilted capillary in the mass spectrometer system allows for efficient ion-neutrals separation, which results in chemical noise reduction in the system and improves sensitivity and ruggedness.

In this embodiment, mass analyzer 13 is a tandem radio frequency three dimensional ion trap-time-of-flight mass analyzer (R. M. Jordan Co., Grass Valley, Calif.). The mass spectrometer system was equipped with one 7 l/s rough pump in the first vacuum region 4 (1.5 Torr), one 60 l/s turbo pump for the second vacuum region 5 ($10^{-2}$ Torr) and a pair of 200 l/s pumps for the mass analyzer vacuum region 5 providing pressures of $1.3\times10^{-5}$ Torr at the ion trap and $3.9\times10^{-7}$ Torr in the time-of-flight region. In the preferred embodiment, radio frequency multipole ion guide 16 is a hexapole with rods 2.5 mm in diameter which are arranged in a circle with a characteristic radius between rods $R_0$=2 mm. The hexapole ion guide is operated at a frequency of 1 Mhz and 300 V peak amplitude.

A set of experiments were carried out with the system schematically shown in FIG. 1. The results of the measurements are shown in FIGS. 2–5.

Figure 2:
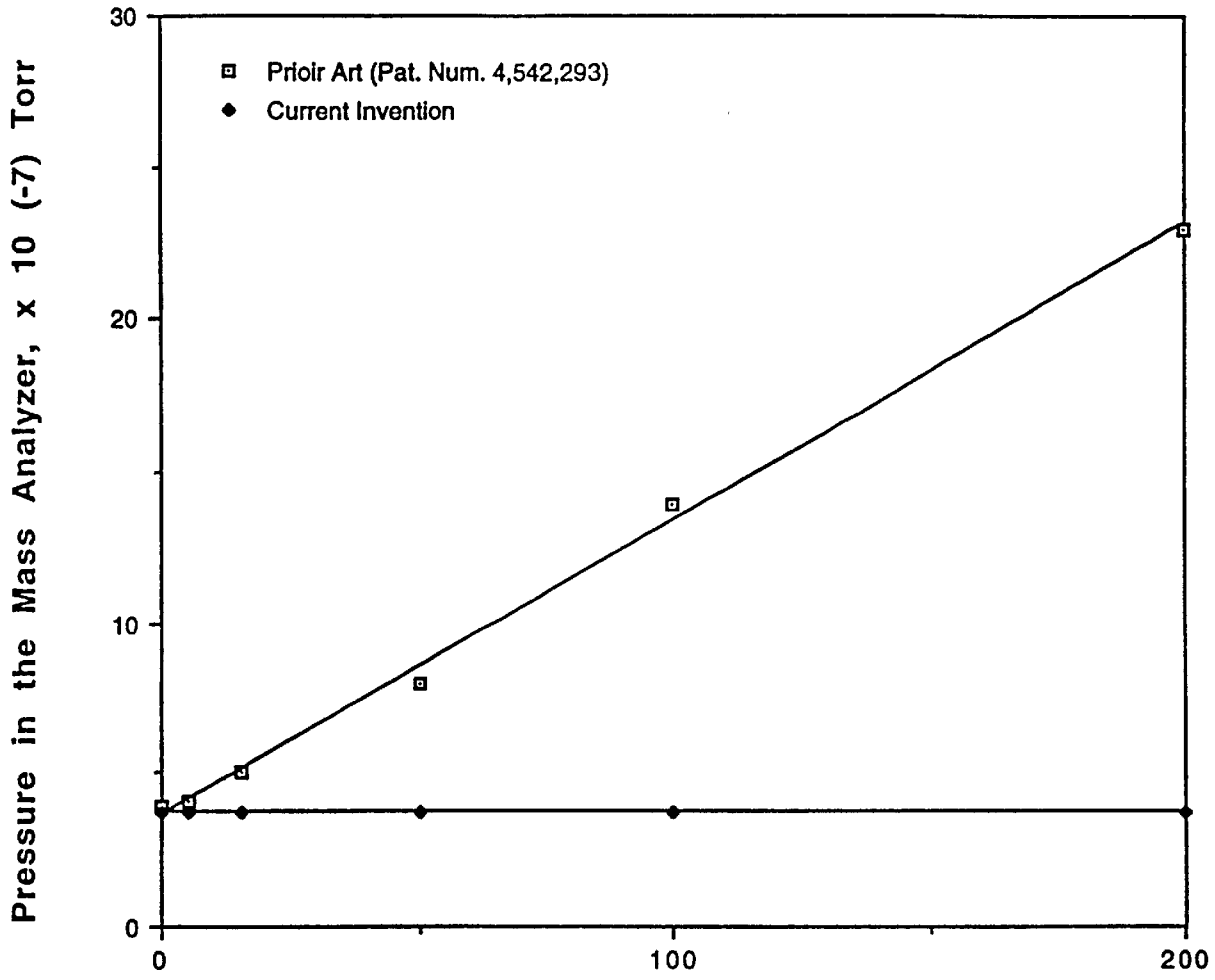
FIG. 2 shows the increase in the pressure of the mass analyzer vacuum region for a time-of-flight ion trap mass analyzer as a function of increased flow of liquid sample into the atmospheric pressure ion source for the prior art method and for the present invention.

FIG. 2 shows the increase in pressure of the mass analyzer vacuum region (time-of-flight region), as a function of increased flow of liquid (50/50% methanol/water with 20 mM ammonium acetate) delivered into the atmospheric pressure ion source for a prior art device and for the present invention. The prior art device with axially aligned capillary, β=0 (U.S. Pat. No. 4,977,320) and the present invention utilized restrictors with identical openings. With the prior art, increasing the flow rate from 1 to 200 μl/min through the electrospray ion source results in a 10 fold increase in the pressure in the mass analyzer region, which indicates poor ion neutral separation. In the system using the present invention, increasing the flow rate from 1 to 200 μl/min produces no increase in pressure in the mass analyzer, proving that efficient ion neutral separation is achieved.

Figure 3:
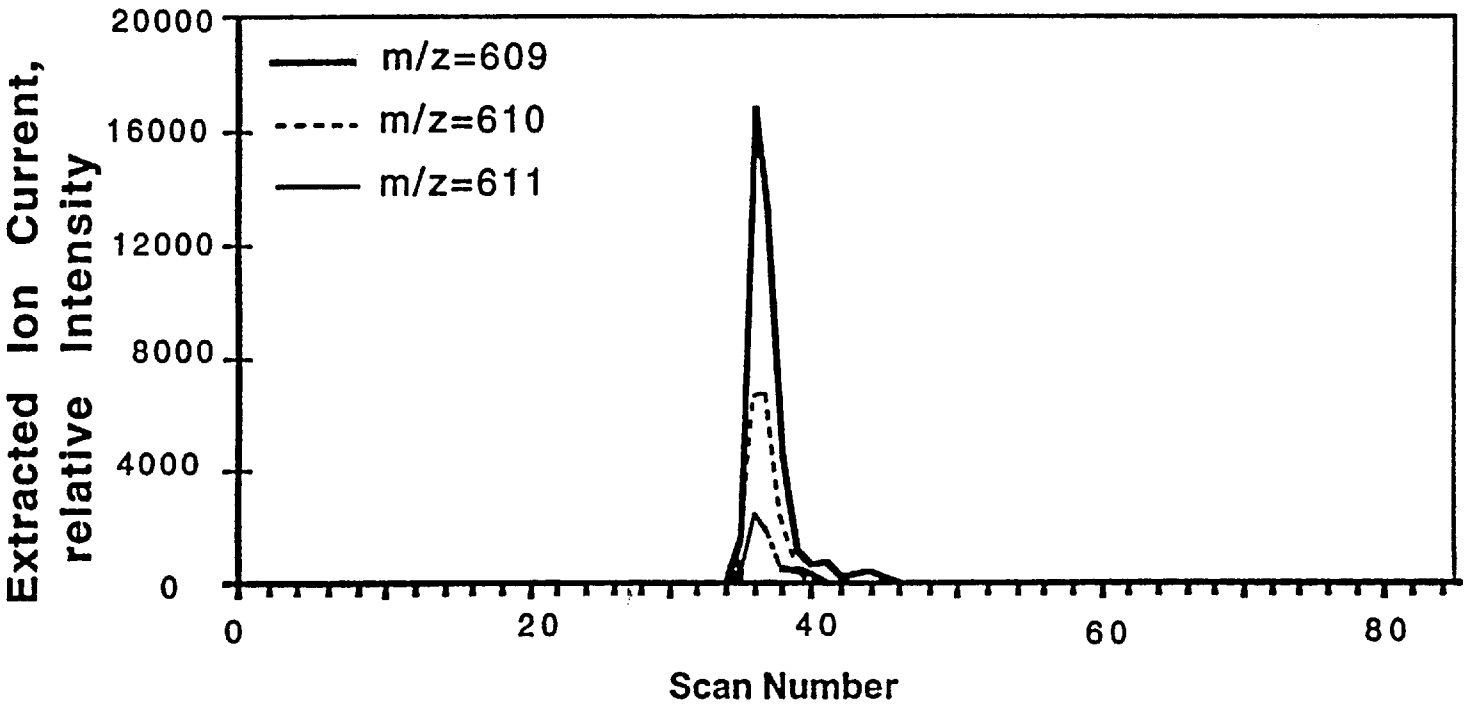
FIG. 3 is the extracted ion chromatogram plot for the high pressure liquid chromatography analysis of reserpine (m/z=609Th for the $^{12}C$ $MH^+$) obtained using the present invention.

To demonstrate the high sensitivity of a mass spectrometer system utilizing the present invention, a high pressure liquid chromatography (HPLC) separation of reserpine was carried out with the output flow of the chromatograph going directly into the electrospray ionizer. A flow rate of 200 microliters per minute of 70/30 methanol/water containing 20 millimolar ammonium acetate and 0.5% acetic acid was passed through the column. A total of 15 picograms of reserpine was injected and mass spectra of ions produced from the chromatographic effluent were recorded every 2 seconds. FIG. 3 shows the extracted ion chromatogram for m/z=609 Th which is the $^{12}C$ protonated molecular ion of reserpine. The chromatograms for m/z 610 and m/z 611, two of the carbon isotope peaks of lesser intensity, are also shown. This result demonstrates the ability of a mass spectrometer system using the present invention to operate at high sensitivity as a liquid chromatography detector.

Figure 4:
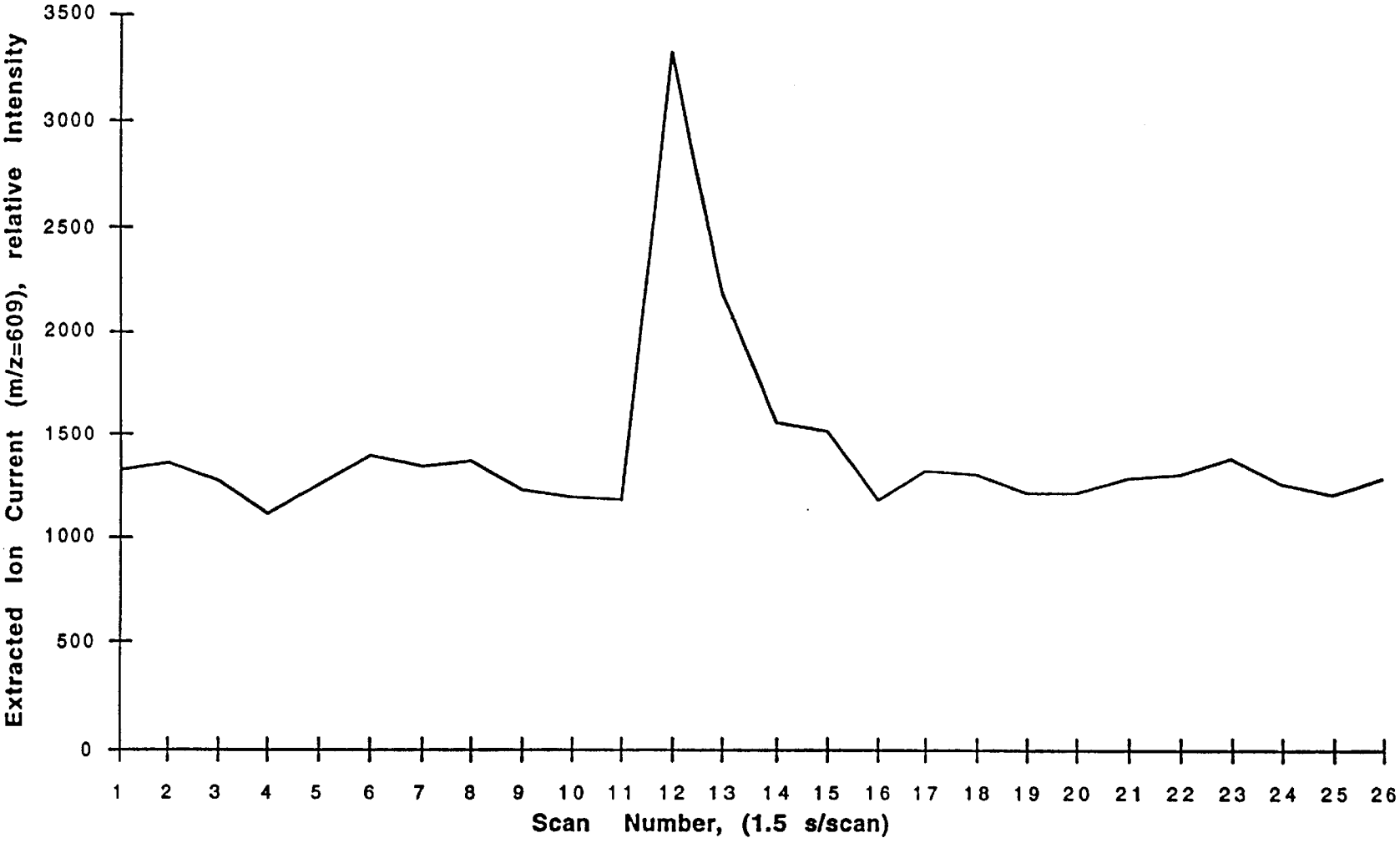
FIG. 4 is the extracted ion chromatogram plot for flow injection analysis of reserpine with total amount sample of 1 pg injected (a flow rate of 200 μl/min of 50/50% methanol/water and 1% acetic acid) obtained using the present invention.

In another set of experiments to determine the ability of the mass spectrometer system to detect small amounts of chemical compounds, flow injection was used to detect reserpine standards. FIG. 4 shows the mass chromatogram of m/z 609 following the injection of 1 picogram of reserpine into a flow of 200 microliters per minute of 50/50 methanol/water containing 1% acetic acid. The peak at scan number 12 with signal-to-noise of about 10 demonstrates the ability of the system to detect very small amounts of sample.

Figure 5:
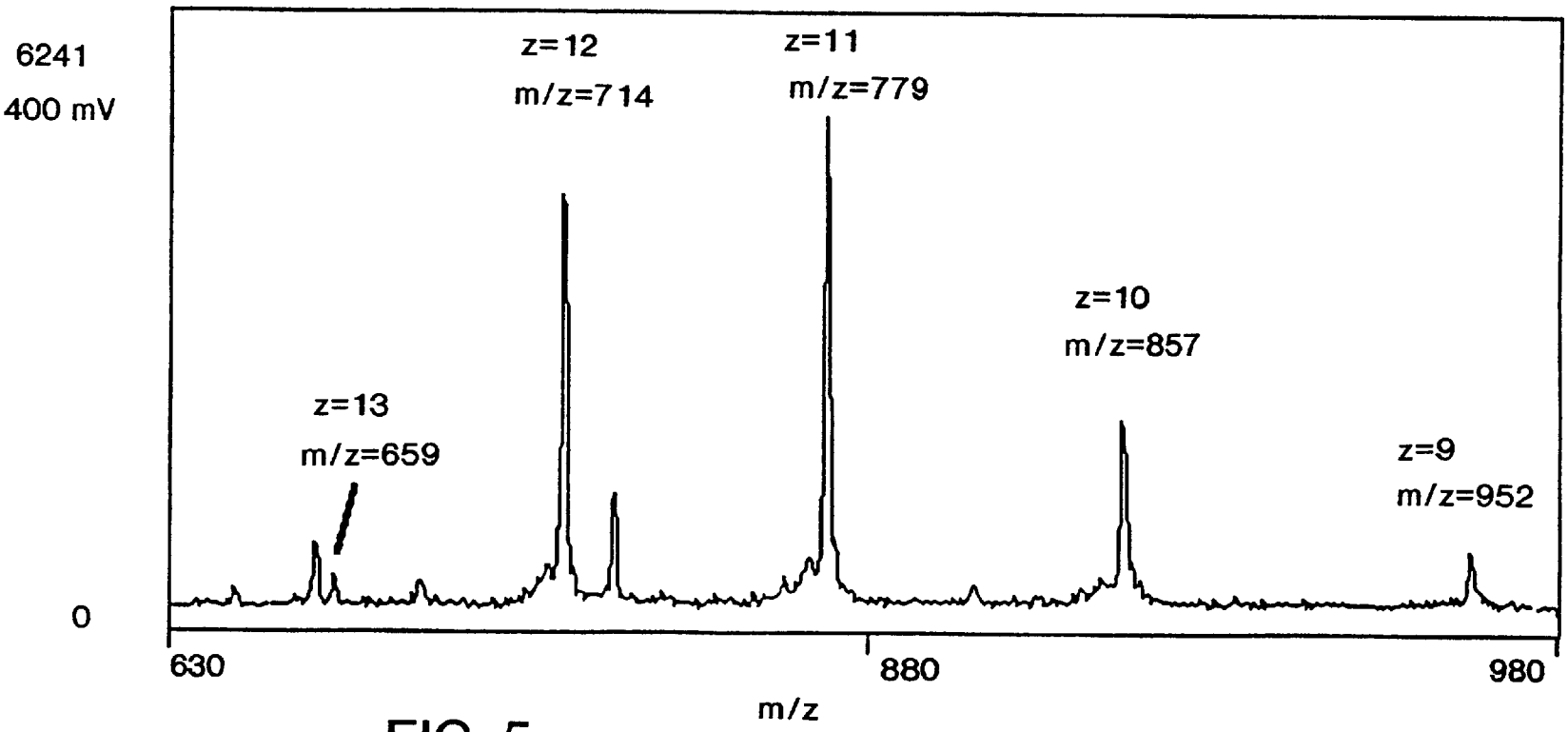
FIG. 5 demonstrates high mass multiply charged ion transmission through the system of the present invention where an electrospray mass-spectrum of Ubiqutin ($M_r$~8570 Da) obtained in the infusion experiments at a flow rate 15 μl/min and concentration of 500 fmol/μl.

FIG. 5 shows an electrospray mass-spectrum of Ubiqutin ($M_r$~8570 Da) obtained in an infusion experiment at a flow rate 15 μl/min and concentration of 500 fmol/μl. Thus ions of high mass can be efficiently extracted and transmitted through the ion introduction device of the present invention. This spectrum demonstrates the transmission of multiply charged high mass ions transported through the system.

Figure 6:
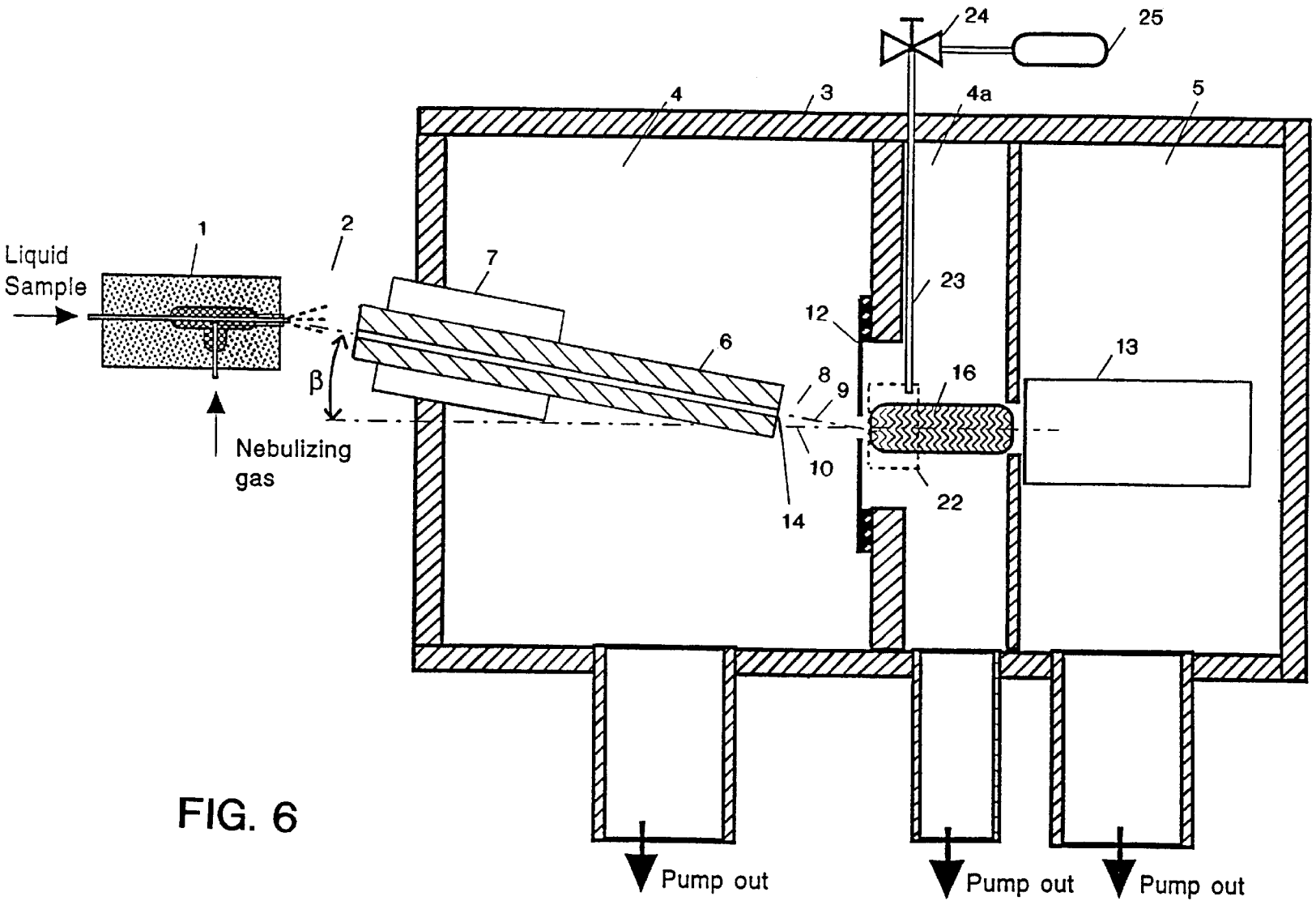
FIG. 6 shows a schematic illustration of a mass spectrometer system utilizing a tilted capillary tube according to another embodiment of the present invention.

There are several different alternative embodiments for the present invention. FIG. 6 shows a schematic illustration of one alternative embodiment. Capillary tube 6 of the sample introduction device is directed straight to the center of the entrance of radio frequency ion guide 16 through the orifice of restrictor 12. High pressure is provided at the ion guide entrance to aid in capturing ions into the ion guide from the angled trajectories. The pressure in the range of between $10^{-1}$ to $10^{-4}$ Torr at the ion guide entrance provides enhanced ion transmission due to ion neutral interaction. Pressurizing of the ion guide entrance is provided by introduction of a buffer gas from external gas tank 25 through the pipeline 23. Leak valve 24 controls the pressure in the region 22. Buffer gas can be an inert gas such as He, $N_2$, Kr, Ar, etc. The buffer gas can also be a chemically reacting gas, which can be used for obtaining a specific chemical reaction between the molecules of gas and ions of the analyzed samples. The pressure at the ion guide exit is determined by the pressure requirements for the mass analyzer and pumping speed of the differential vacuum system. Ion neutral collisions at the ion guide entrance reduce the kinetic energy of the ion beam and focus the ion beam towards the main ion optical axis 10.

There is a preferential position (not illustrated) of the radio frequency ion guide where the individual rods in the ion guide are positioned off the direction of the central axis of the sample introduction device to avoid collisions with neutrals thus preventing contamination and chemical noise.

Figure 7:
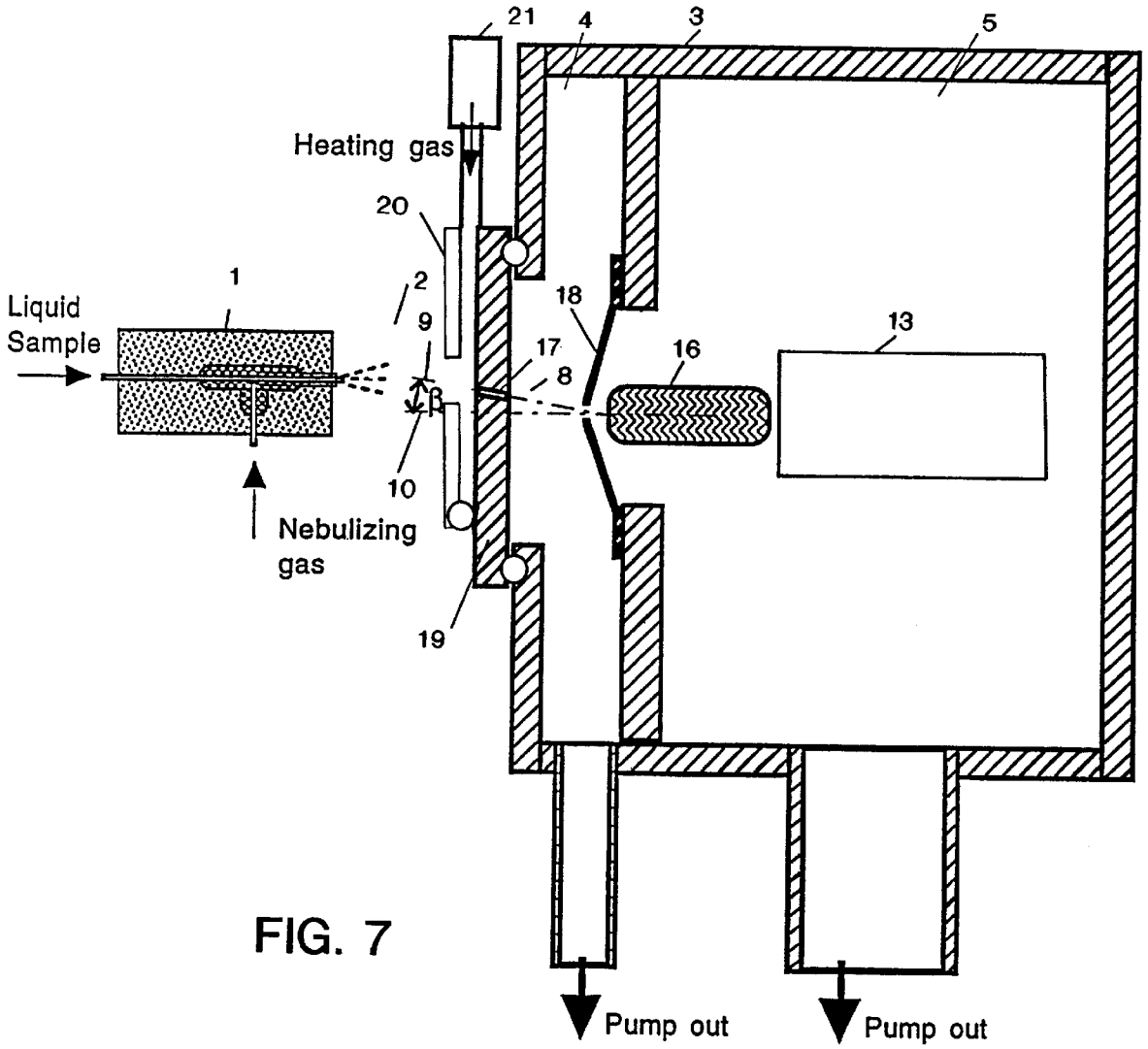
FIG. 7 shows a schematic illustration of the mass spectrometer system utilizing a nozzle sampling device according to the present invention.

FIG. 7 illustrates another embodiment for the present invention where the ion sampling device is a short ion sampling nozzle 17 and conical skimmer 18. Conical skimmer 18 is used as a restrictor between differentially pumped regions 4 and 5. Ions are formed at atmospheric pressure region 2 by an electrospray ion source 1 and are transmitted into first vacuum region 4 through ion sampling plate 19. The additional protective screen 20 is installed in front of the ion sampling nozzle. The heating gas from heat generator 21 is introduced between plates 19 and 20. The heating gas can be dry air, nitrogen or other preheated gas in the range of between 40° C. and 400° C. This gas preheats ions before sampling to assist in the CID process and decrease chemical noise of the system. The heating gas also provides heat for the nozzle to prevent cluster formation. Central axis 9 of nozzle 17 is oriented at an angle β with respect to the main axis of ion optical system 10. The nozzle is positioned in a way that central axis 9 goes substantially close to the center of conical skimmer 18 to transfer ions into low pressure region 5 where ions are extracted from the aerodynamic jet by radio frequency ion guide 16 and directed to mass analyzer 13.

Figure 8:
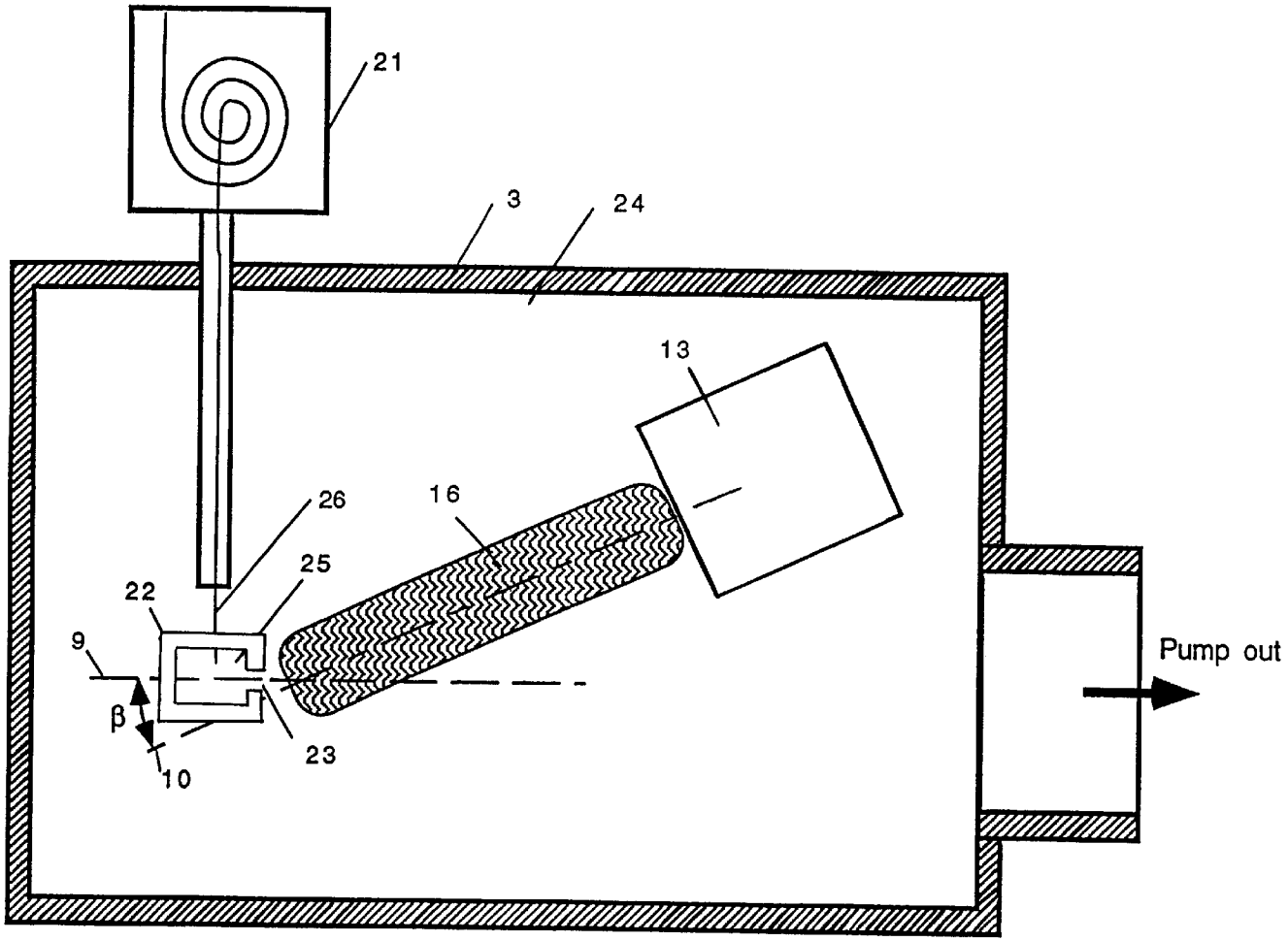
FIG. 8 shows a schematic illustration of the mass spectrometer system utilizing an ion source which is disposed within a vacuum chamber according to another embodiment of the present invention.

In another alternative embodiment shown in FIG. 8 the present invention is utilized with a gas chromatographic (GC) sample introduction. A sample to be analyzed is introduced into GC system 21 for chromatographic separation. The separated sample components are delivered into the mass spectrometer system out of GC system 21 with a GC carrier gas through GC column 26. The mass spectrometer system is enclosed in vacuum chamber 3. GC column 26 is coupled directly to an ion source 22. The GC carrier gas pressurizes the ion source vacuum region 25 to a pressure that is higher than the pressure in vacuum region 24. The gas and ions exit ion source 22 through the narrow passage 23 into vacuum region 24 forming a beam of ions and gas which is directed along central axis 9. This directional ion-gas flow defines ion source 22 of directed flow of mixed ions and gas. Radio-frequency ion guide 16 is disposed along main axis 10 in proximity to the exit of ion source 22. The radio-frequency ion guide is placed so that its main axis 10 is positioned at an angle β with respect to the central axis 9. In this embodiment chromatographic carrier gas molecules pressurize the ion guide entrance and serve as buffer gas molecules thus improving the ion transmission from the ion source to the mass analyzer. Ions are extracted from the gas by radio-frequency ion guide 16 and their trajectories are directed along main axis 10 to mass analyzer 13 while most neutral particles and gas molecules continue their movement along central axis 9 to be pumped away. The pressure requirements for the system depends upon the specific types of ionization technique and the type of mass analyzer in use. The typical pressures in ion source region 25 can be in the range of about 10 to $10^{-4}$ Torr, while the pressure in vacuum chamber 24 can be typically in the range of about from $10^{-3}$ to $10^{-9}$ Torr. The efficient ion neutral separation in the present invention allows the use of lower speed vacuum pumps for achieving the required vacuum conditions and results in compact and less expensive systems.

Figure 9A:
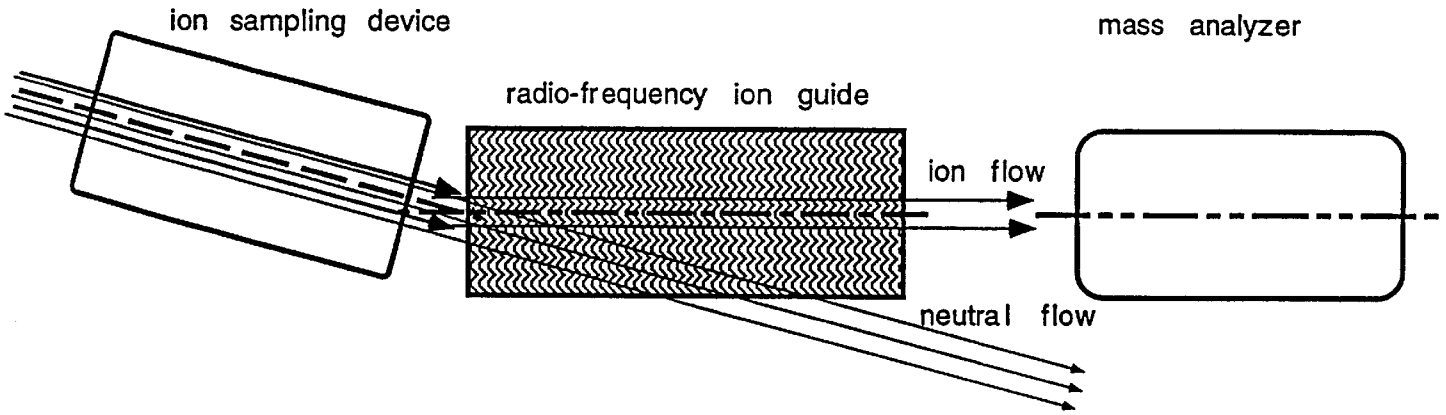
FIGS. 9*a* and 9*b* illustrate the direction of ion-neutral flows where a central axis of the ion sampling device is tilted toward the main axis of the radio-frequency ion guide which is aligned with the core axis of the mass analyzer; and a core axis of the mass analyzer is tilted toward the main axis of the radio-frequency ion guide respectively.
Figure 9B:
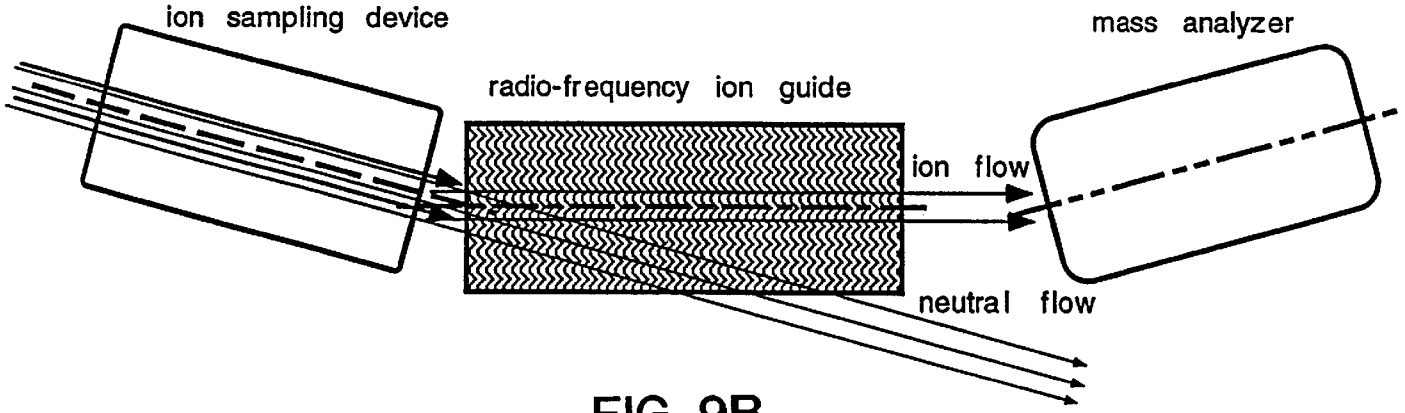

FIG. 9*a* and FIG. 9*b* illustrate the ion neutral flows in the mass spectrometer system according to the present invention and show two different positions of the mass analyzer with respect to the radio-frequency ion guide. In FIG. 9*a*, the main axis of the radio-frequency ion guide is aligned with the core axis of the mass analyzer, while in FIG. 9*b* the main axis of the radio-frequency ion guide is at an angle with respect to the core axis of the mass analyzer. The best position of the mass analyzer axis with respect to the ion guide axis depends on the specific type of the mass analyzer in use. For example, for the quadrupole ion trap mass analyzer and radio-frequency ion guide directly attached thereto, the arrangement of FIG. 9*b* results in improved ion injection efficiency into the trap, and hence improved sensitivity.

It is recognized that the present invention can be used with different types of mass analyzers such as radio frequency three dimensional ion traps, ion cyclotron resonance cells, transmission quadrupoles, time-of-flight, orthogonal time-of-flight, ion trap with time-of-flight, magnetic sector or the tandem combination of the above. The radio-frequency multipole ion guide may be a quadrupole, hexapole, octapole or even higher order multipole.

It is also recognized that the present invention can be used with any appropriate vacuum systems or pumps. Separate vacuum pumps can be used for pumping out differentially pumped regions, or one pump can be used for several regions or multi port vacuum means can be used for pumping out the vacuum chamber of the mass spectrometer system. It is also recognized that different vacuum regions of progressively reduced pressure can be arranged within a single vacuum chamber utilizing a single vacuum pump. Different ionization and nebulization techniques can be used to produce ions at atmospheric pressure or reduced atmospheric pressure including but not limiting to electrospray ionization, atmospheric pressure chemical ionization, and inductively coupled plasma ionization (ICP).

It is recognized that the invention may be useful in situations where the source of ions is at a pressure which is substantially higher than one atmosphere, for example in a mass spectrometer used in conjunction with a supercritical fluid chromatograph apparatus.

It is also recognized that the invention will be useful in situations where the source of ions is at a pressure substantially below one atmosphere, for example in a mass spectrometer equipped with a chemical ionization ion source. In this case, the pressure inside the ion source region is of the order of 0.001 to 0.01 atmospheres and the ions and chemical ionization gases leave the source in a beam having a direction defined by the geometry and orientation of the ion source.

The system for transporting ions and separating them from neutrals described herein may also be useful without mass analyzing ion detectors. For example, N. G. Gotts, et al., (International Journal of Mass Spectrometry and Ion Processes 149/150, 1995, pages 217–229) describe an apparatus in which mass selected ions are injected into a drift cell for the purpose of measuring their mobilities. The drift cell is operated at 3–5 Torr of helium. The present invention could find application in a version of this apparatus in which the ions were not mass selected, but were separated only on the basis of their mobility in the helium drift gas. The invention would improve the performance of such a device by reducing the contamination of the helium drift gas with solvent vapor or air from the high pressure ion source.

In the present invention the initial direction of ion and neutral introduction is changed with respect to the main axis of the system. Due to the action of the radio-frequency quadrupole ion guide, the direction of ion motion and the direction of neutrals are clearly differentiated, thus providing efficient ion transport, from atmospheric pressure into the mass analyzer vacuum region with strong discrimination against transport of neutrals. Because the ion extraction is performed by electrical fields, in contrast to mechanical separation with several consecutive skimmers, the system is subject to less contamination. In addition the mechanical alignment is not crucial for the system, as in prior designs, because the ion introduction path is already strongly misaligned with the axis of the radio-frequency ion guide by the angle β. The present invention provides improved ion-neutral separation resulting in improved sensitivity and ruggedness, reduced chemical noise, and smaller simpler vacuum systems.

What is claimed is:

1. A mass spectrometer system comprising:

an inductively coupled plasma ion source for generating ions in an ionization region;

a vacuum chamber disposed in proximity to said ion source, said vacuum chamber having at least a pair of vacuum regions with a progressively reduced pressure from a front region to a back region of said pair, wherein the front region is adjacent to said ion source;

an ion sampling device comprising an inlet and an outlet opening with a narrow passage therebetween, said passage defining a central axis of said device for transporting ions contained in gas from the ionization region to said vacuum chamber;

a radio-frequency ion guide for passing ions to said back region, said ion guide positioned along a main axis within an intermediate region between the front and back regions and being adjacent to said outlet opening of said sampling device, wherein a space between the outlet opening of said ion sampling device and an entrance of said radio-frequency ion guide is defined an aerodynamic jet region; said aerodynamic jet region having a pressure in a range of about $10–10^{-4}$ torr; the central axis of said ion sampling device being tilted toward the main axis of said radio-frequency ion guide, whereby a trajectory of ion flow is altered by said ion guide and ions are directed along the main axis;

means for introducing a buffer gas into a region adjacent to said radio-frequency ion guide; and mass analyzer for analyzing ions received from said radio-frequency ion guide, said mass analyzer positioned within the back region of said vacuum chamber.

2. The mass spectrometer system of claim 1, wherein the central axis of said ion sampling device approaches the main axis of said radio-frequency ion guide within the entrance of said ion source.

3. The mass spectrometer system of claim 1, wherein said ions source is an inductively coupled plasma ion source.

4. The mass spectrometer system of claim 3, further comprising a lens and a restrictor, said lens and restrictor are concentrically aligned for ion injection into said radio-frequency ion guide.

5. The mass spectrometer system of claim 4, wherein said restrictor is a skimmer.

6. The mass spectrometer system of claim 1, wherein said ion optical system further comprises a restrictor which is positioned in proximity to an entrance of said radio-frequency ion guide.

7. The mass spectrometer system of claim 1, wherein said buffer gas is an inert gas.

8. The mass spectrometer system of claim 7, wherein said inert gas is He.

9. The mass spectrometer system of claim 1, wherein said buffer gas is a chemically reacting gas.

10. The mass spectrometer system of claim 1, wherein said adjacent region is defined by an enclosure which surrounds at least a portion of said radio-frequently ion guide.

11. A mass spectrometer system comprising:

an inductively coupled plasma ion source for generating ions in an ionization region;

a vacuum chamber disposed in proximity to said ion source along a central axis, said vacuum chamber having at least a pair of vacuum regions with a progressively reduced pressure from a front region to a back region of said pair, wherein the front region is adjacent to said ion source;

a nozzle for transporting ions contained in gas from the ionization region to the front region, said nozzle positioned along a central axis between said ion source and said vacuum chamber and having an ion sampling orifice;

a radio-frequency ion guide for passing ions to said back region, said radio-frequency ion guide positioned along a main axis within an intermediate region between the front and back regions and being adjacent to said nozzle, wherein a space between said nozzle and an entrance of said ion guide defines an aerodynamic jet region, said aerodynamic jet region having a pressure in a range of about 10–10–4 torr; the central axis of said nozzle being positioned at an angle with respect to the main axis, whereby the trajectory of ion flow is altered by said guide and ions are guided along the main axis;

means for introducing a buffer gas into a region adjacent to said radio-frequency ion guide; and mass analyzer for analyzing ions received from said radio-frequency ion guide, said mass analyzer positioned to receive ions from said ion guide within the back region of said vacuum chamber.

12. The mass spectrometer system of claim 11, further comprising a restrictor which is positioned in proximity to an entrance of said radio-frequency ion guide.

* * * * *